United States Patent [19]

Mogi

[11] Patent Number: 4,829,931

[45] Date of Patent: May 16, 1989

[54] FIXATION DEVICE

[75] Inventor: Michio Mogi, Tokyo, Japan

[73] Assignee: Konishiroku Photo Industry Co., Ltd., Tokyo, Japan

[21] Appl. No.: 52,199

[22] Filed: May 13, 1987

Related U.S. Application Data

[63] Continuation of Ser. No. 801,088, Nov. 22, 1985, abandoned.

[30] Foreign Application Priority Data

Nov. 27, 1984 [JP] Japan ..... 59-251264

[51] Int. Cl.[4] ..... B05C 11/00

[52] U.S. Cl. ..... 118/60; 118/70; 118/101; 355/289; 432/60; 432/75

[58] Field of Search ..... 118/60, 70, 101; 432/60, 75; 355/3 FU

[56] References Cited

U.S. PATENT DOCUMENTS

| | | | |
|---|---|---|---|
| 4,375,505 | 3/1983 | Newkirk | 118/60 X |
| 4,503,179 | 3/1985 | Yoshimura et al. | 524/262 |

FOREIGN PATENT DOCUMENTS

| | | |
|---|---|---|
| 57-89785 | 6/1982 | Japan . |
| 58-5770 | 1/1983 | Japan . |
| 58-27175 | 2/1983 | Japan . |
| 58-90673 | 5/1983 | Japan . |
| 59-74578 | 4/1984 | Japan . |

*Primary Examiner*—Evan Lawrence

*Attorney, Agent, or Firm*—Frishauf, Holtz, Goodman & Woodward

[57] ABSTRACT

A fixation device which comprises a roller comprising a core member, a fluororesin-containing rubber layer on the core member and a fluororesin surface layer. The fluororesin surface layer has a thickness from 2 to 100 μm, preferably 5 to 30 μm, and surrounds and contacts the outside of the rubber layer.

4 Claims, 2 Drawing Sheets

FIXATION DEVICE

This application is a continuation, of application Ser. No. 801,088, filed Nov. 22, 1985, abandoned.

BACKGROUND OF THE INVENTION

The present invention relates to an improvement of the fixation device for fixing a toner image onto a recording material such as paper in image recording apparatus such as electrophotographic copying apparatus, facsimile, and the like.

In electrophotographic copying apparatus, contact-type heat roller fixation devices are mostly used for fixing an unfixed image onto a recording material such as recording paper. In a process of this type, an unfixed toner image-bearing recording material is transported into between a pair of revolving bodies, a heat roller and a pressure roller which presses the recording material, to thermally fix the toner image onto the recording material. FIG. 1 is a cross-sectional view of a general heat roller-type fixation device, wherein 1 is a cylindrical heat roller having inside a heating means such as heater 1*a*, which rotates clockwise in fixation; 2 is a cylindrical pressure roller which is arranged to press on the heat roller and rotates counterclockwise in fixation; a copying paper sheet P bearing a toner image consisting of unfixed toner T is transported from the right by a transport belt 3 to the heat roller 1 and pressure roller 2 to be pressed and heated to fix the toner and then ejected leftward; 4*a* and 4*b* are separation claws for separating copying paper P, to prevent the paper from wrapping around either heat roller 1 or pressure roller 2; 6 is a felt-like oil pad into which is impregnated a mold lubricant such as silicone oil having an appropriate viscosity; and 5 is a cylindrical cleaning roller made of a brush-like fiber. The cleaning roller 5 revolves to remove the toner residue remaining on the circumferential surface of the heat roller and also serves to supply the mold lubricant properly to the heat roller.

In the prior art, the heat roller 1 has been made of a 2–5 mm-thick Al pipe as a core and has had a 200–500μ-thick silicone rubber or Teflon coating. The pressure roller 2 has been made of a 30 mm diameter cylindrical stainless steel as a core covered with about 5 mm-thick silicone rubber.

Requirements for such roller fixation devices include insuring fixation without offset phenomenon and providing good mold releasability without rumpling the recording paper and, when silicone oil or the like is used as a mold lubricant, providing high wear resistance of the surface of the rollers against the silicone oil, and also against the strike by separation claws and the like.

Fixation devices using the above-described conventional heat-rollers were unsatisfactory for long-term use. For example, a silicone rubber-coated heat roller, although advantageous in that it provides better fixability and fewer rumples on recording paper and a less blurred image than does a Teflon-coated heat roller, has the disadvantage that it is poor in mold releasability. An attempt has been made to coat silicone oil on the silicone rubber-coated surface to improve the mold releasability, but this tends to cause the silicone rubber to swell and to produce a permanent compression set, being accompanied by the disadvantage of significant roller-surface wear due to contact with the separation claws or the like.

For this reason, using fluororesin as the roller surface material has been proposed since it is excellent in mold releasability and does not swell in silicone oil. There have been many proposals for the application of fluororesin to the surface layer of the roller. Japanese Patent Publication Open to Public Inspection (hereinafter referred to as Japanese Patent O.P.I. Publication) Nos. 89785/1982 and 74578/1984 relate to roller fixation devices comprising a roller having a core metal provided with an elastic layer, on which is formed a fluororesin layer. Fluororesin, however, has the disadvantage that it has a high hardness and is quite different from the elastic layer thereunderneath in physical properties such as elastic modulus and when a cardboard-type thick recording paper is fixed by a fixing device using the above roller, cracks appear on the fluororesin layer's portion corresponding to a side edge of the recording paper, and thus the resin lacks durability, because of the different level between the roller surface and the thick paper surface.

Japanese Patent O.P.I. Publication Nos. 135871/1982, 5770/1983, 27175/1983 and 90673/1983 proposes roller fixation devices having a metal core covered with an elastic layer, on which is placed a fluororesin-containing fluororubber layer. These proposals utilize the phenomenon that, when a fluororesin-containing fluororubber is coated and heated to form the roller surface, the fluororesin comes out on the surface, and a fluororesin layer is formed. In this instance, the adherence of the surface fluororesin layer with the base material is excellent, and the thickness of the surface-deposited fuororesin layer is equal to or less than about 1 μm. A fixation device which uses such a roller, although its mold releasability is good, is poor in durability because the surface fluororesin layer is extremely thin.

OBJECT AND SUMMARY OF THE INVENTION

It is an object of the present invention to provide a roller fixation device which uses a roller having fluororesin surface layer as a heat roller or a pressure roller excellent in durability as well as in mold releasability.

The present invention has been made to accomplish the above object. The above object of this invention is accomplished by a fixation device comprising a revolving body to serve as a heat roller or a pressure roller having thereon a fluororesin-containing elastic layer such as a rubber layer, or a layer having a rubber-like elasticity, on the exterior of which is a surface layer formed by coating thereon with a fluororesin, or by a fixation device comprising a revolving body as a heat roller or a pressure roller having thereon a fluororesin-containing rubber layer, on which is formed a fluororesin layer preferably 5 to 30 μm thick.

DESCRIPTION OF THE PREFERRED EMBODIMENTS

Figure 1:
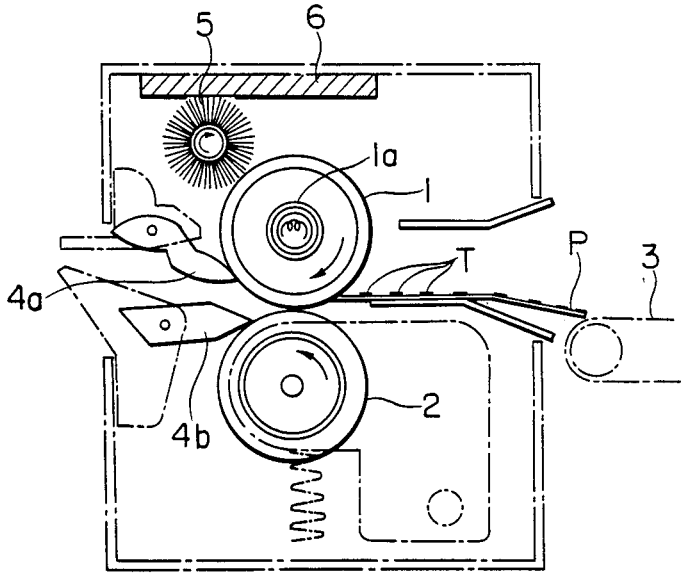
FIG. 1 illustrates a cross-sectional view of an example of the roller-type fixation devices useable with a revolving body according to the invention.

This invention relates, for example, to such a roller-type fixation device as shown in FIG. 1 in which the revolving body thereof is embodied by the invention.

That is, the present invention relates to a fixation device which is such that a fluororesin-containing rubber layer is provided between a metal roller core as the core member or an elastic layer provided on the metal roller core and a fluororesin layer as the surface layer. The fluororesin-containing rubber layer comprises fluororesin or is rich in fluororesin at the portion thereof adhering to the fluororesin of the surface layer, so that the adherence is satisfactory, and therefore the thickness of the fluororesin layer as the surface layer can be relatively freely pacified. The suitable thickness of the fluororesin layer for the roller fixation device is from 2 to 100 μm, and preferably from 5 to 30 μm. Since the metal roller core or the elastic layer provided on the metal roller core and the rubber layer are very well adherent to each other, a good adherence can be obtained between the layers, and since the physical properties such as elastic modulus against external pressure to the roller surface varies reasonably in order from the surface layer, the device is excellent also in durability.

We have been conducting a number of experiments based on the above invention. The following Examples (1-1) and (1-2) wherein this invention is applied to the heat roller and Example (2-1) wherein this invention is applied to the pressure roller willl further illustrate the present invention.

EXAMPLE (1-1)

Figure 2A:
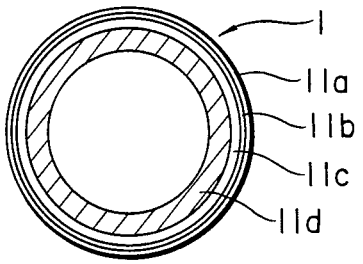
FIG. 2(*a*) and 2(*b*) illustrate the cross-sectional views of each example of the heat-rollers relating to the invention, respectively.
Figure 2B:
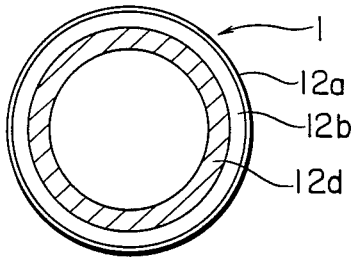

This example is a heat roller having a cross-sectional form as shown in FIG. 2(*a*), wherein 11*d* is a core in hollow cylindrical form made of aluminum having an external diameter of 40 mmϕ and a thickness t=5 mm, and 11*c* is an elastic layer made of a highly heat-resistant silicone rubber with t=30 mm, coated around the circumference of 11*d*.

On the elastic layer 11*c* is coated and burnt a fluororesin-containing rubber layer 11*b*. As the rubber layer a Daikin product Dai El Latex, CLS-213 a mixture of fluororesin with fluororubber, is used. The fluororesin-containing rubber layer 11*b* is formed with a thickness t=20 μm.

On the rubber layer 11*b* is further formed a surface layer using PFA (a product of Mitsui Fluorochemical). The "PGA" is the trade name of a Teflon resin called "Teflon" PFA Fluorocarbon resin, manufactured by E. I. DuPont de Memours and Co. (Inc.). The fluororesin layer 11*a* consisting of PFA coated and burnt on the rubber layer 11*b* has a thickness t=20 μm.

EXAMPLE (1-2)

This example is a heat roller having a cross-sectional form as shown in FIG. 2(*b*), wherein 12*d* is a core metal in the hollow cylindrical form made of aluminum having an external diameter of 40 mmϕ and a thickness of t=5 mm, and 12*b* is a fluororesin-containing rubber layer having a thickness t=300 μm, coated and burnt around the circumference of 12*d*. As the rubber layer a fluororubber is used; a fluororesin-containing Daikin product Dai El Latex, CLS-213 is coated and then burnt.

On the rubber layer 12*b* is further coated and burnt a fluororesin layer 12*a* as the surface layer having a thickness t=20 μm, the fluororesin being PFA (a product of Mitsui Fluorochemical).

EXAMPLE (2-1)

Figure 3:
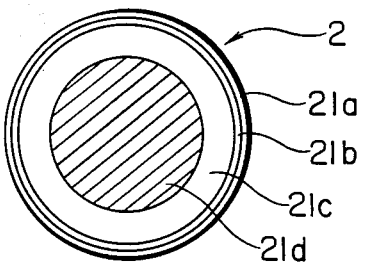
FIG. 3 illustrates an example of the pressure-rollers relating to the invention.

This example is a pressure roller having a cross-sectional form as shown in FIG. 3, wherein 21*d* is a core metal made of a 30 mmϕ SUS, the circumference of which is covered with an elastic layer 21*c* consisting of a silicone rubber (a product of Shin-etsu Chemical Industry Co., Ltd.) having a thickness t=5 mm.

On the surface of the elastic layer 21*c* is coated and burnt a rubber layer 21*b* comprised of a fluororesin-containing fluororubber Daikin product, Dai El Latex, CLS-213.

On the surface of the rubber layer 21*b* is coated and burnt a fluororesin layer 21*a* as the surface layer having a thickness t=10 μm, the fluororesin being PFA (a product of Mitsui Fluorochemical).

COMPARATIVE TEST

A comparative test was made in comparison of the heat rollers (1-1) and (1-2) and the pressure roller (2-1) with those having the same external forms prepared by conventional techniques in the manner of interchanging them in a copying apparatus.

The copying apparatus that was used in the test is U-Bix 3300MR (manufactured by Konishiroku Photo Ind. Co., Ltd.) whose roller fixation device is of the schematic cross-sectional view shown in FIG. 3. Both-side copying test was made under the following test conditions:

| | |
|---|---|
| 1. Copying speed: | 33 sheets/min. (A4-size paper) |
| 2. Transport speed: | 220 mm/sec. |
| 3. Roller fixation device: | |
| 3-1. Surface temperature: | 200° C. (heat roller surface) |
| 3-2. External diameter of heat roller: | 40 mmϕ |
| 3-3. External diameter of pressure roller: | 40 mmϕ |
| 3-4. Pressure force (linear pressure): | 0.5 kg/cm |

(1) HEAT ROLLER COMPARATIVE TEST

The results of the comparative test of Examples (1-1) and (1-2) with those prepared by conventional techniques are given in Table 1.

TABLE 1

| Test No. | Roller condition | Fix-ability | Durability | Both-side copying | Thick paper through |
|---|---|---|---|---|---|
| 1-1 | Core metal + elastic layer + fluororubber + fluororesin | O | O More than 200,000 copies OK | O | O |
| 1-2 | Core metal + fluoro-rubber + fluororesin | O | O More than 200,000 copies OK | O | O |
| 1-3 | Core metal + fluoro-resin | X Low-temp | O | X Rumples | O |

TABLE 1-continued

| Test No. | Roller condition | Fix-ability | Durability | Both-side copying | Thick paper through |
|---|---|---|---|---|---|
| | | run under | | appear | |
| 1-4 | Core metal + elastic layer + fluororesin | O | X Claw-scratches appear after 10,000 copies | O | X Cracks appear |
| 1-5 | Core metal + elastic layer + fluororubber | O | X Offset occurs after 50,000 copies | O | O |
| 1-6 | Core metal + silicone rubber | O | X Claw-scratches appear after 50,000 copies | O | O |

The test numbers (1-1) through (1-4) have fluororesin as the surface layer and have the same surface condition, but differ in the test results, which are attributed, in the cases of (1-1) and (1-2), to (1) the adaptability to external pressure due to the physical characteristic varying in stages from the surface layer toward the inside, (2) the good adherence between the layers, and (3) the slight but effective elasticity to external pressure, which functions effectively to prevent copying paper from being rumpled.

The "Low-temp. run under" in the row of (1-3) of the table means that under-fixation has occurred after a run of 100-copy fixation at a room temperature of 10° C. This is due to the fact that heat is difficult to transmit because the surface of the roller is so hard as compared to that of the other examples that the surface of the roller fails to come into close contact with recording paper or toner; that is, in (1-3), the surface fluororesin lacks elasticity.

(1-5) and (1-6) are examples where fluororubber or silicone rubber is used as the surface layer, and the test results show that they are inferior in the durability to fluororesin.

(2) PRESSURE ROLLER COMPARATIVE TEST

The results of the comparative test of Example (2-1) with those prepared by conventional techiques are given in Table 2. The heat roller that was used in this test is the one previously mentioned as (1-1).

TABLE 2

| Test No. | Roller condition | Durability |
|---|---|---|
| 2-1 | Core metal + silicone rubber + fluororubber + fluororesin | O 200,000 copies OK |
| 2-2 | Core metal + silicone rubber + PFA tube | O 200,000 copies OK |
| 2-3 | Core metal + silicone rubber + fluororesin | X Cracks appear |
| 2-4 | Core metal + silicone rubber + fluororubber | Δ Toner stain appears after 100,000 copies |
| 2-5 | Core metal + silicone rubber | X Toner stain appears after 30,000 copies |

The test Nos. (2-1) and (2-2) both show good results, provided that (2-2) is prepared by putting a silicone rubber-coated core metal into a heat-shrinkable PFA tube and heat-treating the PFA, and care is taken in manufacture to form the external diameter of the pressure roller with high accuracy. The above test result of (2-2) is obtained when a specially highly accurate diameter-having roller is used.

As is apparent from the results of the above-described comparative test, the fixation device which uses the revolving body of this invention is excellent in fixability and also in durability. Particularly this effect becomes more significant when the present invention is applied to both heat roller and pressure roller. The roller surface layer consisting of fluororesin is of course not swelled by silicone oil, and therefore it insures the mold releasability and reduces wear of the surface layer. Also for this reason, silicone oil, etc., is usable. In addition, since fluororesin is electrically insulating, if fixation operations are performed over a long period under a dry condition, the roller surface is charged to possibly cause recording paper to wrap around the roller, resulting in paper separation failure. Accordingly the use of a neutralizer with the roller of this invention is more effective in practicing this invention, the neutralizer being for example a metallic brush arranged so as to be grounded through the copying apparatus body and rubbing the roller surface.

As for the abovementioned fluororesins given in the examples and those used in fluororesin-containing rubbers, tetrafluoroethylene, copolymer of tetrafluoroethylene and hexafluoropropylene and the like which are sold under the trade name, "Teflon", as well as PFA, may be applicable, and further the other fluororesins may also be used.

Also, the fluororesin layers provided over the surface of the fluororesin-containing rubber layers may be applied by various methods besides the coating method and the heating method, provided that no crease will occur after such a fluororesin layer is formed and the shape of a roller will not be deformed. It is needless to say that such coatings include, for example, a spray coating and other popular coating methods.

Besides the abovementioned coating methods, such fluororesin layers may be provided by integrally molding, wetting, wrapping fluororesins around a sheet or a tube at a high temperature, or the like, provided that the interface between the uppermost fluororesin surface layer and the fluororesin-containing rubber layer arranged inside may be well fitted.

What is claimed is:

1. A fixation device which comprises a roller comprising a fluororesin-containing rubber layer and a fluororesin surface layer from 5 to 30 μm thick surrounding and in contact with the outside of said rubber layer.

2. The fixation device of claim 1, wherein said roller comprises a core member, an elastic layer around said core member, said fluororesin-containing rubber layer around said elastic layer, and said fluororesin surface layer around said fluororesin-containing rubber layer.

3. A fixation device for fixing a recording material carrying toners on the surface thereof by pressing and transporting said recording material between two rollers; at least one of said rollers comprising a core member, a rubber layer containing fluororesin around said core member, and a hard fluororesin layer from 5 to 30 μm thick around the outer circumferential surface of said rubber layer.

4. The fixation device of claim 3, wherein both of said rollers comprise a core member, a rubber layer containing fluororesin around said core member and a fluororesin layer surrounding and in contact with the outside of said rubber layer.

* * * * *